US011583783B1

(12) United States Patent
Herren

(10) Patent No.: US 11,583,783 B1
(45) Date of Patent: Feb. 21, 2023

(54) BALLOON TYING STATION AND ORNAMENTIALIZATION OF AN INFLATED BALLOON

(71) Applicant: Gerald R Herren, Cookeville, TN (US)

(72) Inventor: Gerald R Herren, Cookeville, TN (US)

( * ) Notice: Subject to any disclaimer, the term of this patent is extended or adjusted under 35 U.S.C. 154(b) by 0 days.

(21) Appl. No.: 16/687,698

(22) Filed: Nov. 19, 2019

Related U.S. Application Data

(63) Continuation-in-part of application No. 16/124,022, filed on Sep. 6, 2018, now Pat. No. 10,953,338, and a continuation-in-part of application No. 15/694,655, filed on Sep. 1, 2017, now Pat. No. 10,549,208.

(51) Int. Cl.
*A63H 27/10* (2006.01)

(52) U.S. Cl.
CPC ..... *A63H 27/10* (2013.01); *A63H 2027/105* (2013.01); *A63H 2027/1033* (2013.01); *A63H 2027/1041* (2013.01); *A63H 2027/1083* (2013.01)

(58) Field of Classification Search
CPC ..... A63H 27/10; A63H 2027/1033; A63H 2027/105; A63H 2027/1083; A63H 2027/1041
See application file for complete search history.

(56) References Cited

U.S. PATENT DOCUMENTS

| | | | |
|---|---|---|---|
| 888,580 A | 5/1908 | Brinn | |
| 1,008,190 A | 11/1911 | O'Connell | |
| 1,731,574 A | 10/1929 | House | |
| 2,810,379 A | 10/1957 | Solomon | |
| 2,825,592 A | 3/1958 | McKenzie | |
| 3,177,021 A | 4/1965 | Benham | |
| 3,572,788 A | 3/1971 | Cruzan | |
| 3,837,691 A | 9/1974 | Smythe | |
| 4,029,346 A | 6/1977 | Browning | |
| 4,864,762 A | 9/1989 | Cox | |

(Continued)

FOREIGN PATENT DOCUMENTS

| | | | |
|---|---|---|---|
| FR | 2930811 A1 * | 11/2009 | ..... A63H 27/10 |
| GB | 1321066 A | 6/1973 | |

OTHER PUBLICATIONS http://balloonsfast.com/happy-birthday-latex-balloons.html (Dec. 25, 2017, via web archive).*

(Continued)

*Primary Examiner* — Shaun R Hurley
(74) *Attorney, Agent, or Firm* — Baker Donelson; Carl M. Davis, II

(57) ABSTRACT

A method of ornamentializing an inflated balloon with a plurality of ribbon strands secured by knotting in the neck of the inflated balloon, and disclosed apparatus for ornamentializing an inflated balloon using a balloon tying station holding a plurality of spools of ribbon for selectively dispensing longitudinally across an extending cantilever to underlie a neck portion of the inflated balloon, which neck portion extends stretchingly around the cantilever and looping over and under for pulling off the cantilever and catching the ribbons to tie the knot and secure the ribbons therein, the ribbons having first and second strands cut to a selected length and secured in the knot. An apparatus for ornamentalizing an inflated balloon for a balloon bouquet is disclosed.

15 Claims, 10 Drawing Sheets

(56) References Cited

U.S. PATENT DOCUMENTS

| | | | | | |
|---|---|---|---|---|---|
| 4,876,981 | A * | 10/1989 | Barnhart | G09F 17/00 | 116/173 |
| 4,934,986 | A * | 6/1990 | Wallace | A63H 27/10 | 446/220 |
| 4,989,906 | A | 2/1991 | Peverley | | |
| 5,004,633 | A * | 4/1991 | Lovik | A63H 27/10 | 244/31 |
| 5,016,428 | A | 5/1991 | Helling | | |
| 5,021,022 | A | 6/1991 | Ganz | | |
| 5,035,391 | A * | 7/1991 | Steele | A63H 27/10 | 248/346.03 |
| 5,039,142 | A | 8/1991 | Muma | | |
| 5,067,301 | A | 11/1991 | Shore | | |
| 5,098,137 | A | 3/1992 | Wardall | | |
| 5,314,217 | A | 5/1994 | Place | | |
| 5,403,222 | A * | 4/1995 | Koenig | A63H 3/06 | 446/175 |
| 5,568,950 | A | 10/1996 | Herren | | |
| 5,611,578 | A | 3/1997 | Angelico | | |
| 5,638,581 | A * | 6/1997 | Burke | A63F 9/0079 | 24/3.13 |
| 5,732,530 | A | 3/1998 | Pfaff | | |
| 5,797,783 | A * | 8/1998 | Harris | A63H 27/10 | 40/124.05 |
| 5,820,169 | A | 10/1998 | Butler et al. | | |
| 5,904,258 | A * | 5/1999 | Farmer | A47B 81/00 | 211/123 |
| 5,938,154 | A * | 8/1999 | Bartels | A63H 27/10 | 248/176.1 |
| 6,273,479 | B1 | 8/2001 | Carlson | | |
| 6,745,904 | B1 * | 6/2004 | Komar | A47F 5/01 | 211/13.1 |
| 6,902,212 | B1 | 6/2005 | Mize | | |
| 7,967,344 | B2 | 6/2011 | Herren | | |
| 8,157,297 | B2 | 4/2012 | Spilbor | | |
| 8,292,335 | B1 | 10/2012 | Hemingway | | |
| 10,549,208 | B1 | 2/2020 | Herren | | |
| 2006/0016153 | A1 | 1/2006 | King | | |
| 2008/0121309 | A1 | 5/2008 | Boise | | |
| 2011/0240823 | A1 * | 10/2011 | Hua | A63H 27/10 | 248/505 |
| 2011/0253255 | A1 | 10/2011 | Dellaquila | | |
| 2011/0316275 | A1 | 12/2011 | Wainohu | | |
| 2012/0130416 | A1 | 5/2012 | Okos | | |
| 2016/0325150 | A1 | 11/2016 | Johnson | | |

OTHER PUBLICATIONS https://designimprovised.com/2015/10/halloween-jack-o-latern-balloon-garland.html (Year: 2015).*

* cited by examiner

BALLOON TYING STATION AND ORNAMENTIALIZATION OF AN INFLATED BALLOON

REFERENCE TO RELATED APPLICATIONS

The present application is a continuation-in-part of co-pending U.S. patent application Ser. No. 16/124,022 filed Sep. 6, 2018 and a continuation-in-part of co-pending U.S. patent application Ser. No. 15/694,655 filed Sep. 1, 2017, each incorporated herein by reference in its entirety.

TECHNICAL FIELD

The present invention relates to apparatus and methods for ornamentialization of an inflated balloon knotted to a ribbon. More particularly, the present invention relates to apparatus and methods for ornamentialization of an inflated balloon using an apparatus for knotting the inflated balloon by tying a knot in a neck portion of the inflated balloon and selectively having one or more ribbons secured in the knot, which knotted ribboned balloon may collect in sequence with other knotted ribboned balloons for balloon bouquets.

BACKGROUND OF THE INVENTION

The events services industry provides a wide range of products for parties, celebrations, and event gatherings including table settings, ornaments, center pieces, and other decorative appointments. Casual, party, and promotional events often include decorative balloons for ornamentation. The inflated balloons are used, for example, balloon arches (balloons positioned in a group for an arch), balloon drops (gathered inflated balloons held in an overhead net for release to persons below), balloon releases (gathered floatable balloons inflated with helium and held in a net for simultaneous release), and balloon bouquets having a plurality of helium inflated floating balloons (a number of balloons secured with elongated colorful ribbons to a weighted base).

Balloons inflated with helium float upwardly, and thus are typically secured with colorful elongated ribbons to a weight. The ribbon lengths may vary, such that a plurality of the balloons gathered together form a bunch of colorful balloons. Generally, the balloons are inflated and connected to the ribbon in a manual process. The ribbon is selected from various colors typically supplied as an elongated strand on a spool from which a length is unwound and cut to length. Assembly involves inflating one of the balloons with helium supplied through a gas supply nozzle connected to a helium cylinder, which gas supply nozzle inserts into a neck portion of the balloon. Upon inflating, the balloon is then knotted by tying a knot in the neck portion to prevent escape of the helium through the neck portion. One of several spools of ribbon is selected and a free end tied to the neck portion. The ribbon is pulled and cut to selected length to provide a knotted ribboned balloon. With the colorful elongated ribbon tied to the neck portion, the inflated knotted ribboned balloon floats upwardly to collect in a holding pen suspended or mounted to a ceiling. Holding pens typically have grid-like or fence walls that restrict lateral movement of the balloons from the holding pen. The ribbons hang downwardly, and a balloon bouquet may be assembled by gathering a plurality of the balloons from the holding pen and attaching the distal free ends of the ribbons to a weight.

Inflated balloons may subsequently be ornamentialized with a plurality of elongated strands of ribbons cut to length and tied to a neck portion that is knotted to seal the inflated balloon. However, cutting and tying such other ribbons, particularly with the inflated balloon induced to float freely upward, is time consuming and laborious. While such assembly and collecting of knotted ribboned balloons provides balloons that may be selected and gathered together for a balloon bouquet, there remains a need for an apparatus and methods to assist the production of inflated balloons knotted with colorful ribbons for ornamentialization such as for collecting together as a bouquet of inflated balloons. It is to such that the present invention is directed.

SUMMARY OF THE INVENTION

The present invention meets the need in the art by providing a method for ornamentializing an inflated balloon, comprising the steps of:

(a) providing a supply of a first ribbon and a supply of a second ribbon for ornamentializing an inflated balloon having a neck portion for knotting a knot with respective portions of the first ribbon and the second ribbon;

(b) pulling the first ribbon a first length relative to a neck portion of the inflated balloon to position a portion of the first ribbon adjacent the neck portion for being engaged to the knot when knotting the neck portion;

(c) pulling the second ribbon a second length relative to the neck portion of the inflated balloon to position a portion of the second ribbon adjacent the neck portion for being engaged to the knot when knotting the neck portion;

(d) knotting the neck portion of the inflated balloon with a portion of the respective portions of the first ribbon and the second ribbon to secure the first ribbon and the second ribbon in the knot and thereby defining (i) a first strand of the first ribbon extending from the knot to a distal end of the first ribbon and (ii) a first strand of the second ribbon extending from the knot to a distal end of the second ribbon;

(e) cutting the first ribbon between the knot and the supply of the first ribbon to define a second strand of the first ribbon of a third length; and (f) cutting the second ribbon between the knot and the supply of the second ribbon to define a second strand of the second ribbon of a fourth length, whereby the first strand of the first ribbon defines an elongated ribbon for holding the inflated balloon from floating away and the respective second strand of the first ribbon and the first and second strands of the second ribbon ornamentialize the inflated balloon.

In another aspect, the present invention provides a method for ornamentializing an inflated balloon, comprising the steps of:

(a) providing a knotted inflated balloon;

(b) bending an elongated member having a plurality of fiber bristles extending therefrom at a portion intermediate opposing distal ends to the knotted neck of the inflated balloon;

(c) attaching a pair of ribbons to the elongated member, each proximate a respective one of the distal ends of the elongated member; and (d) attaching each one of a pair of ornamental devices to a respective one of the pair of ribbons.

In another aspect, the present invention provides an apparatus for ornamentializing an inflated balloon, comprising a plurality of ribbon supplies each providing an elongated ribbon and a knotting device having an elongated trough for receiving thereround a neck portion of an inflated balloon with a ribbon gathering distal end portion of the trough for holding a respective portion of the plurality of ribbons pulled to selected respective lengths from the ribbon supplies and extending longitudinally from a first end of the trough past the distal end of the trough, whereby the neck of the balloon being inserted under a portion of the neck that extends transverse across the trough and pulled longitudinally from the trough simultaneously seals the inflated balloon while knotting the plurality of ribbons therein.

Objects, advantages, and features of the present invention are readily determined upon a reading of the following detailed description in conjunction with the drawings and the appended claims.

DETAILED DESCRIPTION

Figure 1:
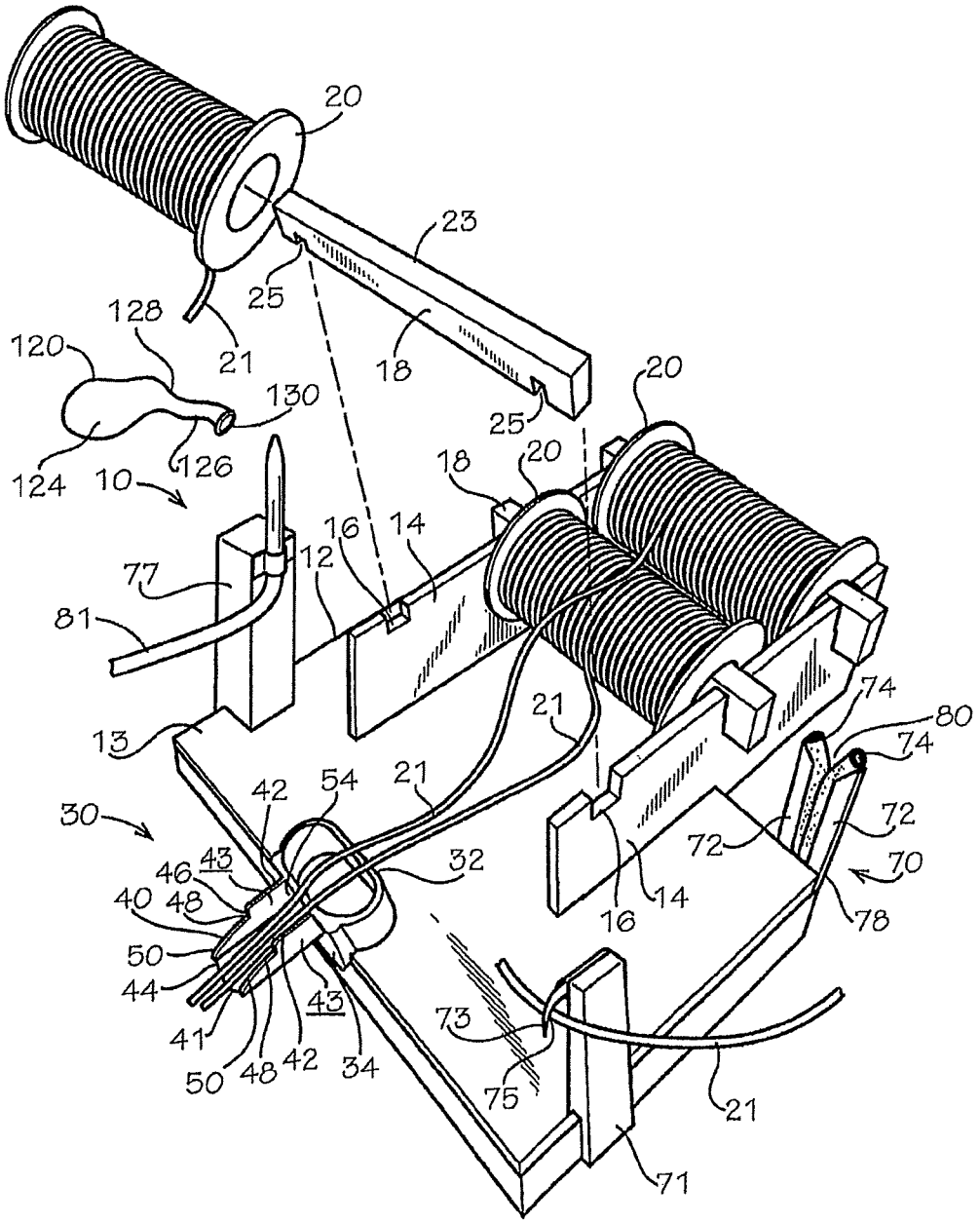
FIG. 1 illustrates in perspective partially exploded view a balloon tying station according to the present invention.

With reference to the drawings, in which like parts have like identifiers, FIG. 1 illustrates a balloon tying station 10 according to the present invention. The balloon tying station comprises a rack 12 comprising a base plate 13 also referred to as the support plate 13) and a pair of opposing walls 14 in spaced-apart relation extending from the base plate. Each wall 14 defines a plurality of spaced-apart slots 16, or recessed openings, aligned with the slots in the opposing wall. Each opposing pair of slots 16 receives an axle 18 for receiving a spool 20 of balloon ribbon 21. FIG. 1 illustrates a first axle exploded away from the walls 14 to illustrate the pair of slots 16 that receive the axle, with other axles having spools of ribbon received in the respective other pairs of slots in the walls 14. The axle 18 in the illustrated embodiment comprises an elongate member 23 having spaced slots 25 in opposing end portions. The slots 25 and the slots 16 in one of the respective pairs in the walls 14 engage lockingly.

Figure 5:
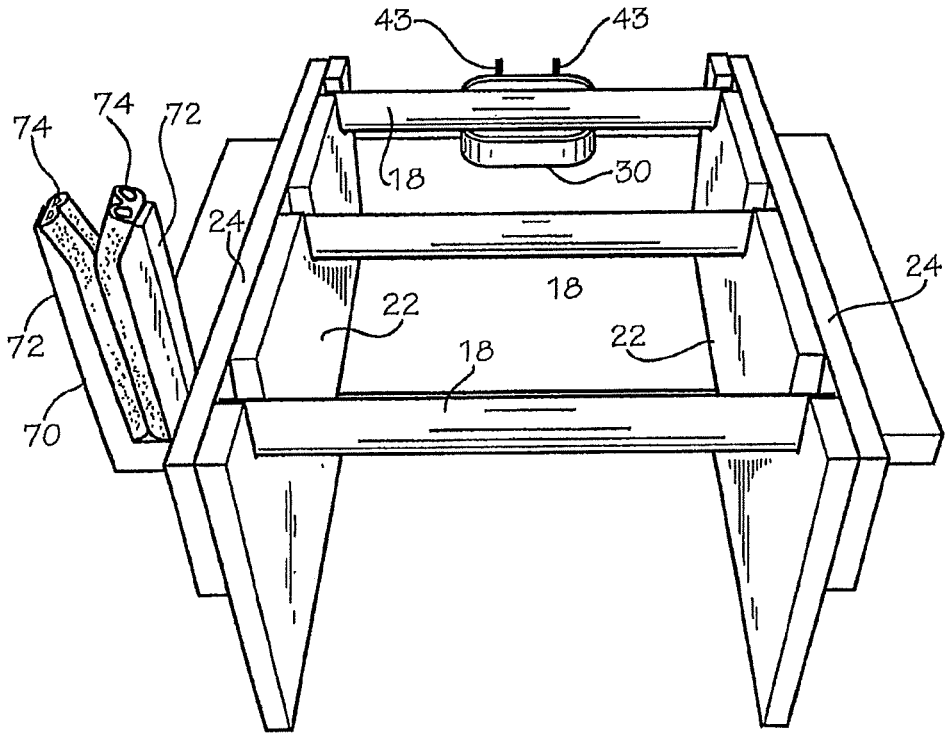
FIG. 5 illustrates an end perspective view of an alternate embodiment of a balloon tying station.

In an alternate embodiment illustrated in FIG. 5, each wall 14 comprises a first plate 22 having the slots 16 and a second plate 24 attached outwardly of the first plate 22. The second plate 24 provides a closing back for the slots 16 to restrict movement of the axles 18 outwardly of the slots during use. The axle 18 in this alternate embodiment is an elongated cylindrical member. In an alternate embodiment, the axle is a spring-biased tube having opposing telescoping members.

With continued reference to FIG. 1, the support plate 13 extends from an edge of the walls 14 in a first direction that is a dispensing direction for dispensing balloon ribbon longitudinally from a respective one of the spools 20 on one of the axles 18. A balloon tying device 30 mounts to the support plate 13 spaced from the end of the walls 14. In the illustrated embodiment, the balloon typing device 30 mounts to a distal edge portion of the support plate 13. The balloon tying device 30 assists with the formation of a knot in a neck portion of an inflated balloon, as discussed below. The balloon tying device 30 in the illustrated embodiment has a base 32 and a brace tab 34 extending perpendicularly from the base. The base 32 seats on the support plate 13 with the brace tab 34 abutting a side face of the distal edge of the support plate 13. Fasteners such as screws install through openings in the brace tab 34 to secure the balloon tying device 30 to the support plate 26. The balloon tying device 30 may attach with other securing structures.

The balloon tying device 30 incudes a cantilever 40 that extends outwardly from the support plate 13. The cantilever 40 is trough-shaped generally 41 in cross-section. The cantilever 40 preferably defines an arcuate exterior surface. The cantilever 40 has two opposing upper edges 42 for opposing walls 43 and a curved exterior surface 44. The upper edges 42 terminate at a respective vertically extending retaining edge 46 that leads to a generally horizontal plateau 48. The retaining edge 46 maintains the position of a stretched portion of the neck portion of the balloon during the knot tying steps discussed below. The plateau 48 keeps the balloon tying operation sufficiently above the cantilever trough for insertion of a finger into the trough during balloon-tying operations. An arcuate or curved holding edge 50 extends from the plateau 48 to an end 52 of the cantilever 40. The arcuate or curved shape of the holding edge 50 facilitates the removal of a tied balloon by reducing the circumference of the stretched portion of the balloon about the cantilever 40 and therefore promoting the rolling-off of the tied balloon from the cantilever.

The axially oriented trough 41 or recess establishes during a balloon tying process a space 54 or opening proximate the base 32 through which a thumb and a finger of a balloon-tying operator can push and pull the neck end of a balloon in order to complete a knot in the neck portion of the balloon. The recess 54 should therefore be at least ⅝ inch wide, and preferably ¾ inch wide to fit most normal sized human fingers.

A tying end, or neck portion, of a balloon wraps on the exterior surface around the cantilever for tying a knot in the balloon as discussed below. A balloon tying device suitable for use as the balloon tying device 30 in the balloon tying station 10 is disclosed in my co-pending U.S. patent application Ser. No. 15/694,655, filed Sep. 1, 2017, incorporated herein in its entirety by reference. In an alternate embodiment, the balloon tying device comprises an elongated tying member that extends as a cantilever from the support plate, which tying member fixedly seats on the support plate. For example, the elongated member is a cylindrical member that extends as a cantilever.

Figure 2:
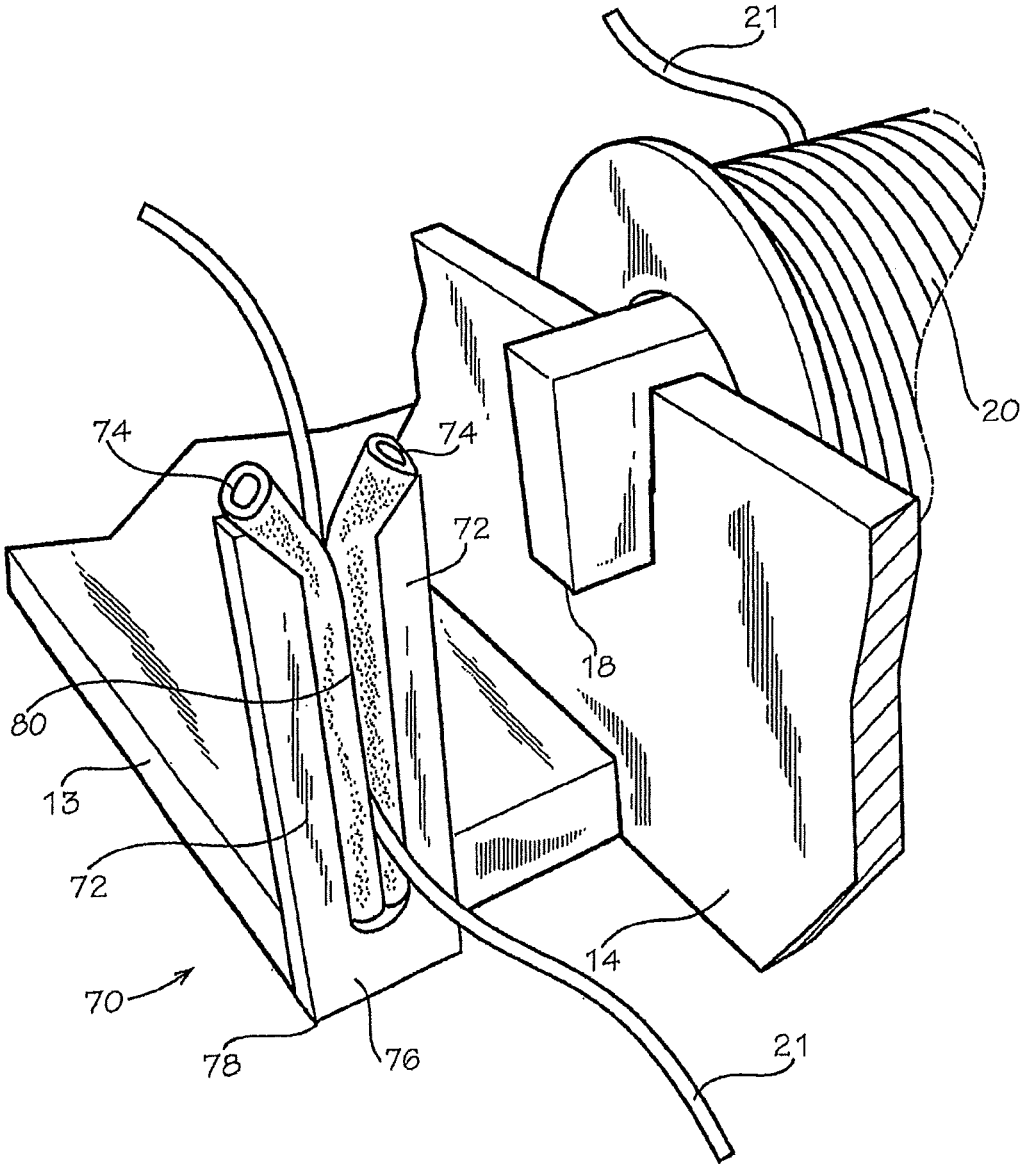
FIG. 2 illustrates a detailed perspective view of a balloon holder illustrated in FIG. 1.
Figure 6:
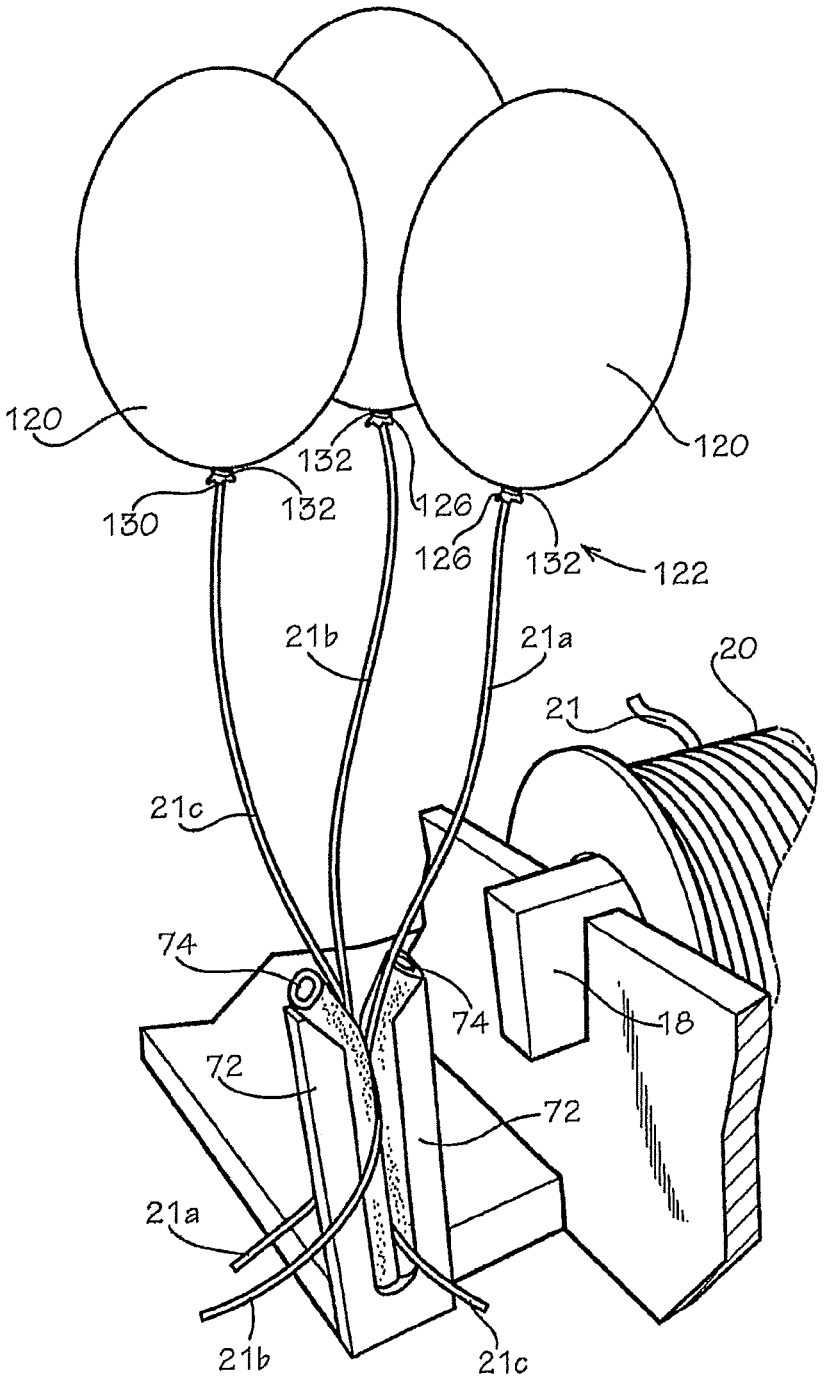
FIG. 6 illustrates in detailed perspective view the balloon holder illustrated in FIG. 1 retaining a plurality of inflated knotted ribboned balloons for gathering a balloon bouquet.

Optionally, a balloon ribbon holder 70 attaches to the balloon tying station 10 for holding a plurality of the balloon ribbons each connected to the knot of a respective inflated knotted ribboned balloon, for assembly of a group of the balloons as a balloon bouquet. The balloon ribbon holder 70 has a pair of spaced-part legs 72. Each leg 72 includes a resilient member 74 attached on a face opposing the other leg. The resilient members 74 are elongate rubber bulbs or pliable thermoplastic rubber bulbs. The resilient members attach with an adhesive on the respective leg 72 in opposing relation. As illustrated in FIG. 2, the legs 72 may extend from a base 76 to define an elongated U-shaped frame 78. Alternatively, the legs extend as separate members in spaced relation. The resilient members 74 touchingly contact and define a flexible passing slot 80 from an open end. The passing slot 80 receives a portion of the ribbon of the knotted ribboned balloon. The resilient members 74 bearing against the ribbon hold the knotted ribboned balloon proximate the balloon station 10. As additional knotted balloons are assembled with balloon ribbons using the balloon tying station, the balloon ribbon holder 70 receives the additional balloon ribbons of the subsequent knotted ribboned balloons for collecting as a group for a balloon bouquet, as illustrated in FIG. 6.

A cutter support 71 attaches to the support plate 13 lateral of but proximate to the balloon tying device 30. A cutter blade 73 attaches at a free distal end of the cutter support. The cutter blade 73 in the illustrated embodiment has a curved sharpened edge 75 for cutting the ribbon 21 at a selected portion.

An inflator support 77 attaches to the support plate 13 lateral of but proximate to the balloon tying device 30. An inflator nozzle 79 connects to a supply tube 81 that engages a gas cylinder (not illustrated), such as a helium tank, for inflating the balloons. Alternatively, the supply tube 81 connects to a supply of pressurized air, for inflating non-floating balloons such as for balloon arches. The inflator nozzle 79 has end for attaching to a mating connector on the supply tube 81, such as a threaded end sized for threading to a connector having an interior thread at the end of the supply tube 81.

In the illustrated embodiment, the inflator support 77 attaches to support plate to the left of the balloon tying device 30 while the cutter support 71 attaches to the right. This facilitates the balloon inflation, knotting and collecting process, as discussed below.

Figure 3A:
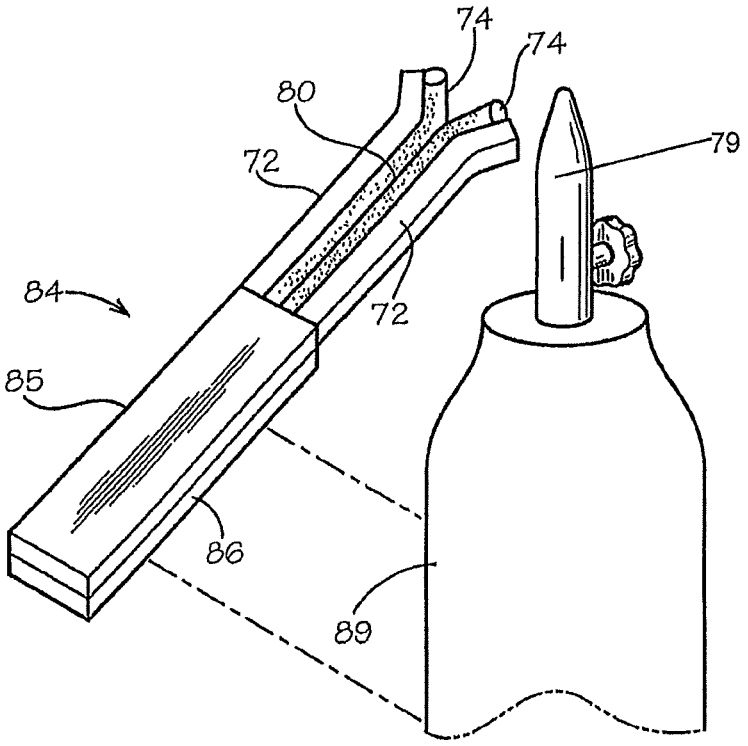
FIG. 3A illustrates in perspective view an alternate embodiment of a balloon holder.

FIG. 3A illustrates in perspective view an alternate embodiment 84 of the balloon holder 70. The balloon holder 84 includes a mounting plate 85 from which the legs 72 extend. In the illustrated embodiment the mounting plate 85 includes a magnet 86 for detachably engaging to a steel helium cylinder 89. The balloon tying operator thus may selectively position the legs 72 for receiving the ribbon of knotted ribboned balloon assembled with the balloon tying station 10. The balloon tying operator thus may selectively position the balloon holder proximate the balloon tying station 10 for receiving the ribbon 21 of knotted ribboned balloons in the passing slot 80 during the assembly process.

Figure 3B:
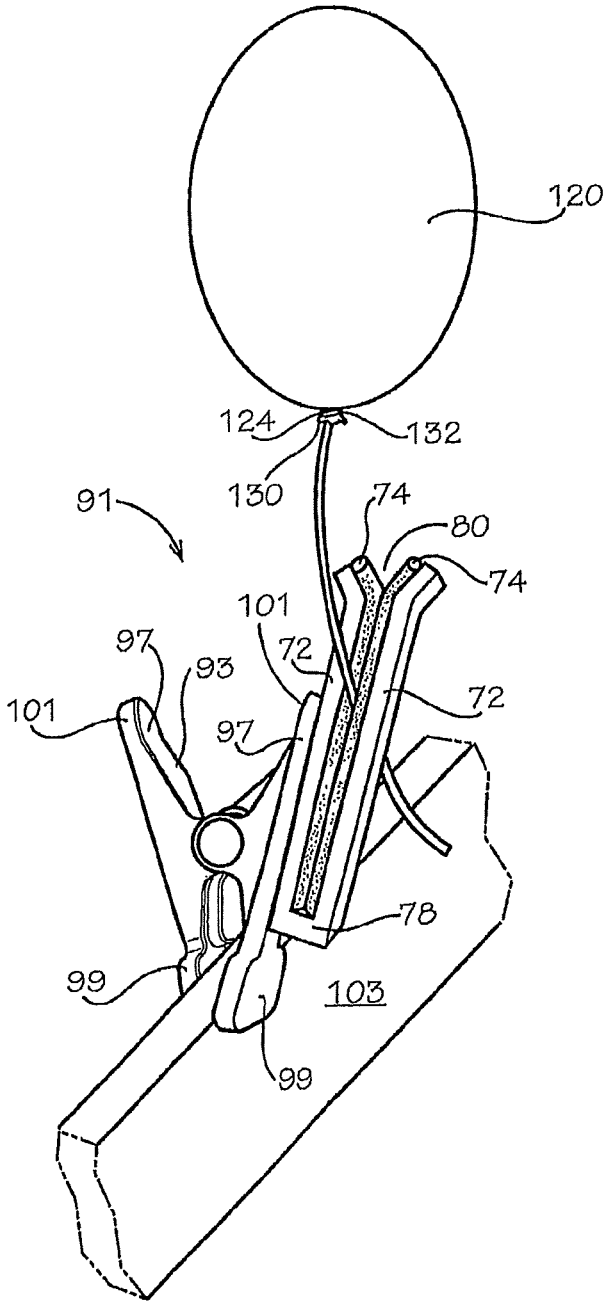
FIG. 3B illustrates in perspective view a second alternate embodiment of a balloon holder.

FIG. 3B illustrates in perspective view a second alternate embodiment of the balloon holder 91 that includes a spring-biased jaw-clip 93 for detachably engaging the balloon holder to a support (not illustrated). The jaw-clip 93 includes opposing arms 97 with opposing gripping pads 99 at a first end and a pivot arm 101 at an opposing end. The frame 78 attaches to or is integral with one of the arms 97, whereby the legs 72 and resilient members 74 extend in a first direction. A spring at an axis biases the arms 97 to a first closed position forcing the gripping pads 99 together towards the opposing pad. Applying force on the pivot arms 101 moves the gripping pads 99 apart to a second open position for clipping to a support 103. The balloon tying operator thus may selectively position the balloon holder proximate the balloon tying station 10 for receiving the ribbon 21 of knotted ribboned balloons in the passing slot 80 during the assembly process.

Figure 4:
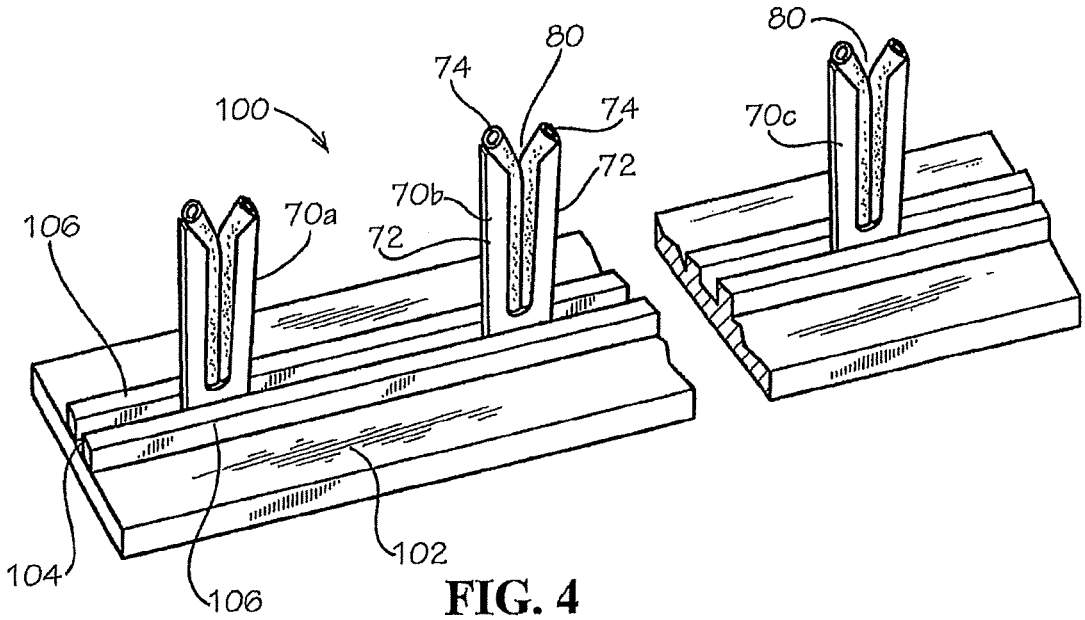
FIG. 4 illustrates in perspective view a balloon holder assembly.

FIG. 4 illustrates in perspective view a balloon holding station 100 having an elongate base 102 with a channel 104 that receives a plurality of the frames 78 of the balloon holders 70 in spaced-relation. In the illustrated embodiment, a pair of spaced-apart elongate members 106 define the channel 104.

FIG. 5 illustrates an end perspective view of an alternate embodiment of a balloon tying station, as discussed above. Each wall 14 comprises the first plate 22 having the slots 16 and the second plate 24 attached outwardly of the first plate 22. The second plate 24 provides a closing back for the slots 16 to restrict movement of the axles 18 outwardly of the slots during use. The axle 18 in this alternate embodiment may preferably be an elongated cylindrical member.

FIG. 6 illustrates in detailed perspective view the balloon holder 70 illustrated in FIG. 1 retaining a plurality of inflated knotted ribboned balloons 120 for gathering a balloon bouquet generally 122. The balloon 120 has a balloon body 124 and a neck portion 126 that extends from a connecting portion 128 next to the balloon body and terminates in an open end 130. The inflated knotted ribboned balloons 120 have a knot 132 in the neck portion 126 proximate the inflator opening 130 for the balloon with a ribbon 21 secured in the knot. A distal free end portion of the respective ribbon 21 seats in the passing slot 80 of the balloon holder 70, for collecting a plurality of balloons 120 for the balloon bouquet 122.

With reference to FIGS. 1 and 6, the balloon tying station 10 operates to form the knot 132 in the neck portion 126 of the inflated balloon 120 while securing an end section of the ribbon 21 in the knot, which ribbon, being cut to length, provides the knotted ribboned balloon, for use for example with other knotted ribboned balloons in a balloon bouquet 122. The axles 18 receive the respective spool 20 of ribbon and each axle seats in one of the pairs of opposing slots 16. The ribbon 21 from the spool 20 extends laterally in the dispensing direction and longitudinally along the cantilever 40 of the balloon tying device 30. Alternately, more than one ribbon may be extended along the cantilever 40 for knotted into the knot in the neck of the balloon. An alternate embodiment uses an enlongate cylindrical member, such as a pipe, around which the balloon neck is looped, with a portion held during the looping to form a passage for the leading open end to pass for forming the knot in the balloon neck.

Briefly described as to the illustrated embodiment, the balloon tying operator (an inflatist) first inflates a balloon 120 by positioning the open end 130 of the balloon neck on the inflator nozzle 79. The nozzle 79 opens for gas flow into the balloon, conventionally opening by bending the nozzle from vertical. The inflated balloon is then knotted with the knot 132 formed in the neck portion 126 using the balloon tying device 30, as discussed in detail below. The knotting steps further catch the ribbon 21 (if disposed in the trough 43 for a ribboned balloon), which ribbon is secured in the knot 132. The ribbon 21 of the knotted ribboned balloon then is positioned next to the cutter blade 73, and with a pulling motion, caused to be cut against the cutter blade 75. A distal portion of the cut ribbon then inserts into the passing slot 80 of the balloon ribbon holder 70 for collecting with other inflated knotted ribboned balloons.

More particularly described, the inflated balloon 120 (not yet knotted) is held with a thumb of a hand of a balloon tying operator bearing the connecting portion 128 of the neck portion 126 against the shoulder or the exterior of the wall 43 of the balloon tying device 30. While still pressing on the connecting portion 128, the operator pulls on the open inflation end 130 of the balloon to stretch the distal extent of the neck portion 126 of the balloon across the cantilever 40. The neck portion 126 stretches across the open trough 41 over the respective opposing plateaus 48, and wraps around the side, bottom, and opposing side of the cantilever 40 until the stretched neck portion of the balloon crosses over itself. This is discussed in my patent application Ser. No. 15/694,655.

The knot forming steps continue with the open end 130 and neck portion 126 then passed over the portion stretched between the walls 43, and then downwardly into the recess 54 of the trough 41, under the balloon neck portion stretched between the walls 43, and upwardly from the trough 41 proximate the end 52, thereby forming a half-hitch knot in the neck portion 126 around the cantilever 40. The open end 130 of the neck portion 126 is then pulled to slide the knot 94 distally off the cantilever 40 and catching the ribbon 21 which is positioned secured within the knot 132. The end 130 is rapidly pulled to tightness to complete the half-hitch knot 132 with the ribbon 21 in the knot, to seal the inflated balloon 120, hold the compressed air or gas in the balloon, and secure the ribbon in the knot. The tail or open end 130 of the balloon is pulled outwardly in a direction away from the base 32 from the cantilever 40 along a line substantially coaxial with a longitudinal axis of the cantilever. Pulling the tail pulls the stretched balloon portions along the arcuate edge and past or over the radiused portions 50 of the walls 43 of the trough 41. The ribbon 21 unwinds from the spool 20 to a selected length, and the ribbon is cut selectively to length using the cutter blade 73 as discussed above. In an alternate embodiment, two or more ribbons 21 may be knotted in the knot of the inflated balloon.

A balloon arch is readily constructed similarly. However, rather than cutting the ribbon, a second inflated balloon is attached to a selected portion of the ribbon by the tying steps discussed above. Alternatively, or in combination in an arch, a second ribbon may be pulled to length, and a distal free end tied to the inflated knotted ribbboned balloon. The balloon assembly station 10 may gainfully be used for knotting inflated balloons without the ribbon 21, for example, for collecting balloons for use in a balloon drop or ornamental arrangement of balloons that do not require floating.

The knotted ribboned balloon 120 may then be collected for grouping with other knotted ribboned balloons to form the balloon bouquet 122. In the illustrated embodiment, the ribbon of the knotted ribbboned balloon slidingly enters the passing slot 80 defined by the opposing legs 72 by the contacting resilient members 74. The passing slot 80 receives additional ribbons of knotted ribboned balloons assembled with the balloon tying station 10, for collecting as a group for a balloon bouquet.

Alternatively, with reference to FIG. 3A, the ribbon of the inflated knotted ribboned balloon may be received in the passing slot 80 of the balloon holder 84 magnetically secured by the magnet 86 to a helium tank 89 positioned proximate the balloon tying station 10, for convenient assembly of inflated floatable balloons for collecting a bunch for a balloon bouquet.

Alternatively, with reference to FIG. 3B, the ribbon of the inflated knotted ribboned balloon may be received in the passing slot 80 of the balloon holder 91 that selectively secured by the jaw-clip 93 to the support 103 positioned proximate the balloon tying station 10, for convenient assembly of inflated floatable balloons for collecting a bunch for a balloon bouquet.

Alternatively, with reference to FIG. 4, the ribbon of the inflated knotted ribboned balloon may be received in the passing slot 80 of one of the balloon holders 70 positioned spaced-apart on the balloon holding station 100.

The balloon assembly station 10 may be used for inflating and knotting non-floatable balloons, such as for collecting in a group for ornamentation uses or for balloon drops. The supply tube 81 connects to a supply of pressurized air.

Figure 7:
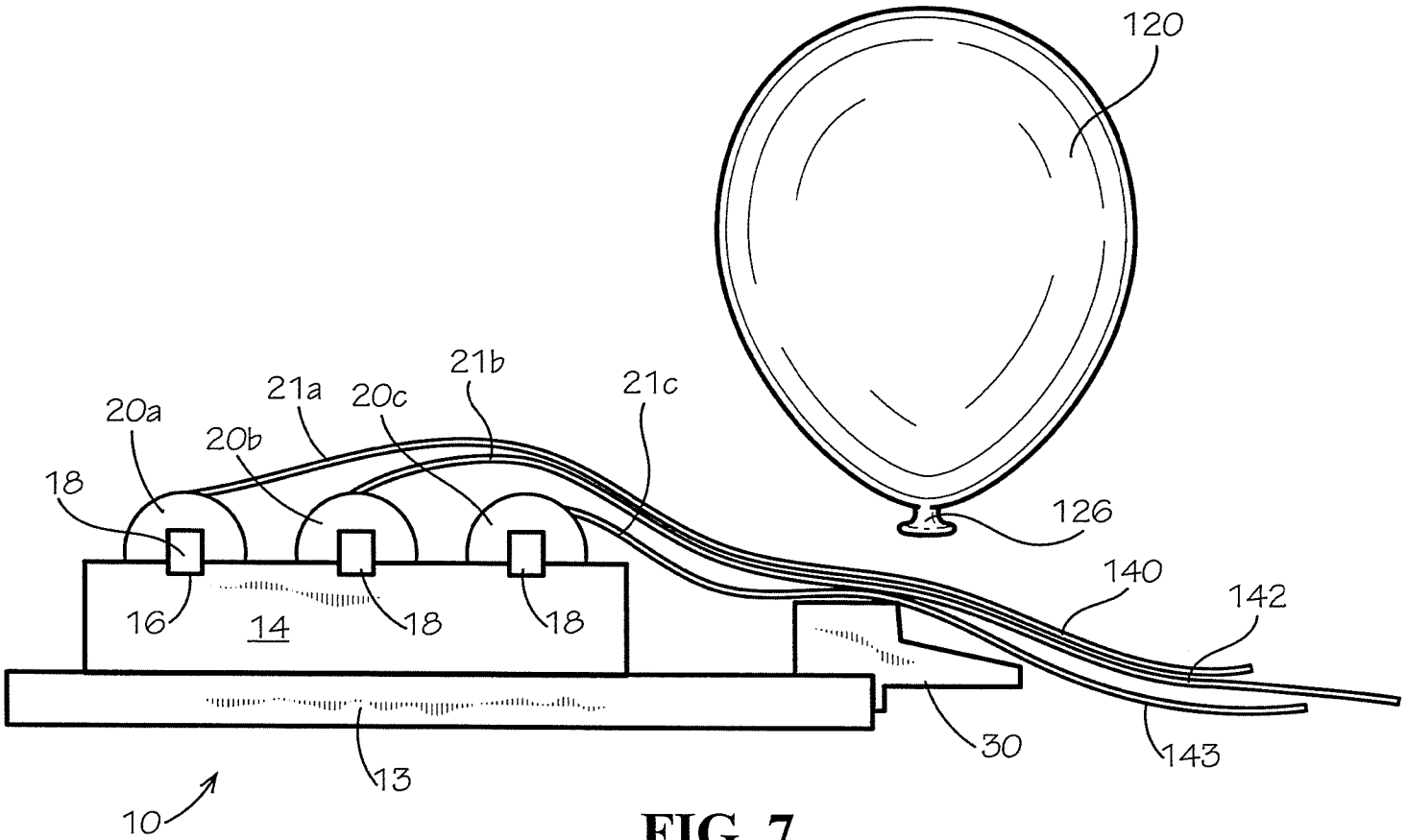
FIG. 7 illustrates in side view the balloon tying station in use during a method for ornamentializing an inflated balloon with a plurality of ribbon strands in accordance with the present invention.

FIG. 7 illustrates in side view the balloon tying station 10 in use during a method for ornamentializing an inflated balloon with a plurality of ribbon strands in accordance with the present invention for making the inflated balloon a work of artistic endeavor. The balloon tying station 10 supports a plurality of spools 20*a*, 20*b* and 20*c* of ribbon (three spools are illustrated but the apparatus and method may use a first ribbon and at least one second ribbon extending from respective spools) for attaching to the neck of the balloon during a knotting step disclosed herein. Thus, multiple ribbons may be used. The first ribbon 21*a* and at least the second ribbon 21*b* are used for ornamentializing the inflated balloon 120 by securing to the knot 132 formed in the neck to seal the balloon from deflation. The first ribbon 21*a* is pulled longitudinally a first length relative to the neck portion of the inflated balloon 120 for defining a first strand 140 of the first ribbon 21*a*. The second ribbon is pulled longitudinally from the spool 21*b* a second length relative to the neck portion 132 of the inflated balloon 120 for defining a first strand 142 of the second ribbon 21*b*. (Other ribbons may be gainfully supplied to provide respective first stand portions relative to the neck of the inflated balloon 120, such as the illustrated first strand portion 143 of the ribbon 21*c*.) The present invention accordingly knots a plurality of ribbons simultaneously with a single knot to seal an inflated balloon while securely engaging the ribbons without requiring individual tying of separate knots for the ribbons.

The ribbons 21 are secured by knotting the neck of the inflated balloon in the process step discussed above, whereby a portion of the respective ribbons 21*a*, 21*b*, 21*c* are secured in the knot formed to seal the inflated balloon from deflation. Alternatively, one or more of the ribbons 21 may be twine or string, and further, the twine or string may be treated with a colorant.

Figure 8:
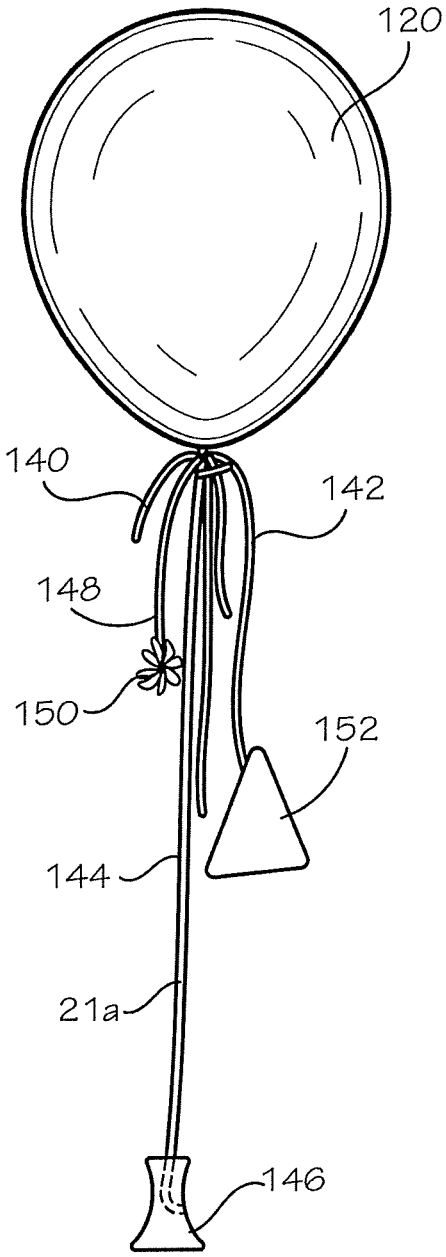
FIG. 8 illustrates in side view an inflated balloon ornamentialized with a plurality of ribbon strands.

With reference to FIG. 8 that illustrates in side view the inflated balloon 120 ornamentialized with a plurality of ribbon strands, the respective ribbons 21*a*, 21*b* are then cut to selected lengths. The first ribbon 21*a* is cut at a third length relative to the knot in the inflated balloon to define a second strand 144 of the first ribbon 21*a*. Such is generally elongated an appropriate length for allowing the inflated balloon to elevate a distance from a mass device 146 to which the distal end portion of the second stand 144 is secured to restrict the inflated balloon from flying away. Similarly, the second ribbon 21*b* is cut at a fourth length relative to the knot 132 in the inflated balloon 120 to define a second strand 148 of the second ribbon. Other ribbons if used are similarly cut to respective different lengths to define respective second strands of each of the respective ribbons extending from the knot of the inflated balloon.

Also, the strands of same or different lengths may be mechanically curled, optionally for ornamentation and artistic purposes. Ornamental ribbons typically include expending ribs for facilitating forming curls and curves in the ribbon by passing the ribbed surface over an edge, such as an edge of a scissors. The second strand of the first ribbon thereby defines an elongated ribbon band for remotely securing the inflated balloon to the mass 146 for resisting floating away of the inflated balloon and the respective first stand of the first ribbon and the first and second strands of the at least second ribbon ornamentialize the inflated balloon.

The ribbon strands may be further ornamentialized by attaching an ornamental device 148. The ornamental device may be a bow 150 (such as a commercially available pre-formed ribbon bow having an adhesive attacher sheet), a conical party hat 152, a signage 153 such as card or announcement related to a celebratory event with appropriate text message or graphics, a sticker, a toy, or other ornamental character or feature with a descriptive text or article related to a theme or to the design expressed in the balloon bouquet. For example, the ornamentation and balloon bouquet may be themed, such as for example, a nature-based theme, for example, butterflies printed on the balloon with butterfly-shaped cards attached to the ribbons; a celebratory event, such as a birthday with a birthday message printed balloon and with cards illustrating for example gift packages, a gift package or envelope for a gift card, or other celebratory indicia attached to the ribbons; a heart-shaped balloon with attached heart-shaped cards, heart devices, or stickers.

The first lengths and the second lengths of the respective ribbons 21 may differ or be the same, or one may be longer than the other, in accordance with ornamentialization of the inflated balloon. Generally one resulting strand will be a length for allowing the inflated balloon to elevate a reasonable distance, such as for a gripping handle for transporting the balloon or for elevating above a support such as a table.

Figure 9:
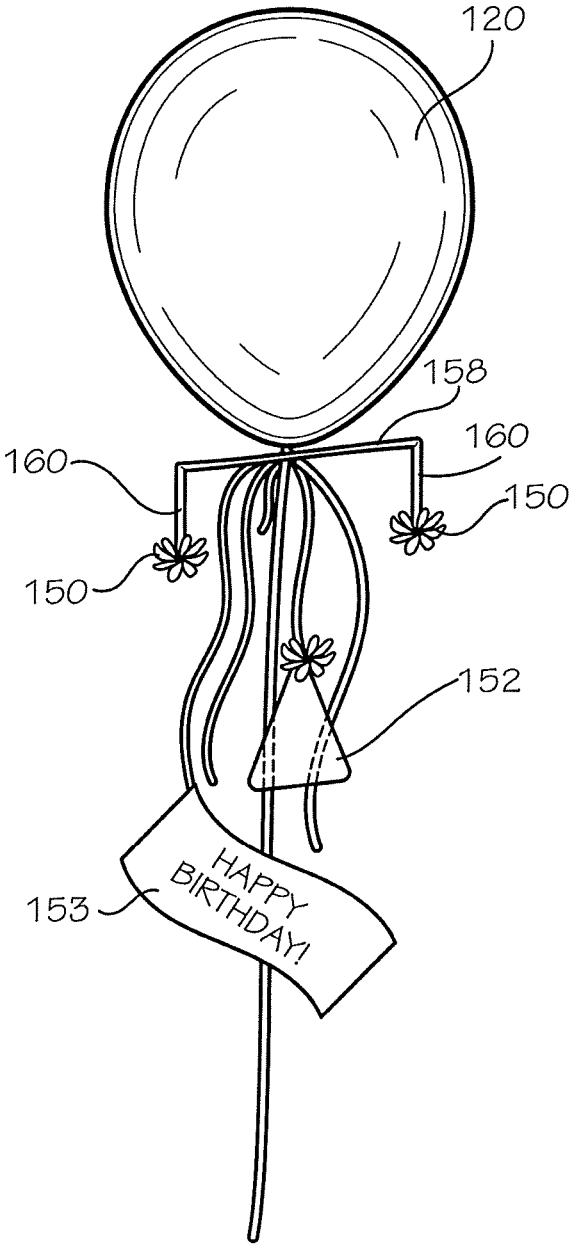
FIG. 9 illustrates in side view an inflated balloon ornamentialized with an elongate member attached to a knotted neck and having ornamental devices attached thereto.

FIG. 9 illustrates in side view an inflated balloon ornamentialized with an elongate member 158 that attaches to the knotted neck 132 and has ornamental devices 150 attached to elongated ribbons 160 that secure to respective portions of the elongated member 158. The elongate member 158 may be a rigid, semi-rigid, or bendable member. A rigid or semi-rigid member attaches using a length of a ribbon or other fastening device. The bendable member may attach similarly with a ribbon, or alternatively, bend about the knot 132 at an intermediate portion. A preferred elongated member 158 comprises a wire having a plurality of fiber bristles extending therefrom, such as a crafts fiber/wire stand, pipe cleaner, or similar structure. One or more ribbon members 160 attach to the member 158 and may be ornamentally treated with one or more ornamental devices 148 or may be curved or curled as noted above, for ornamentialization of the inflated balloon.

Figure 10:
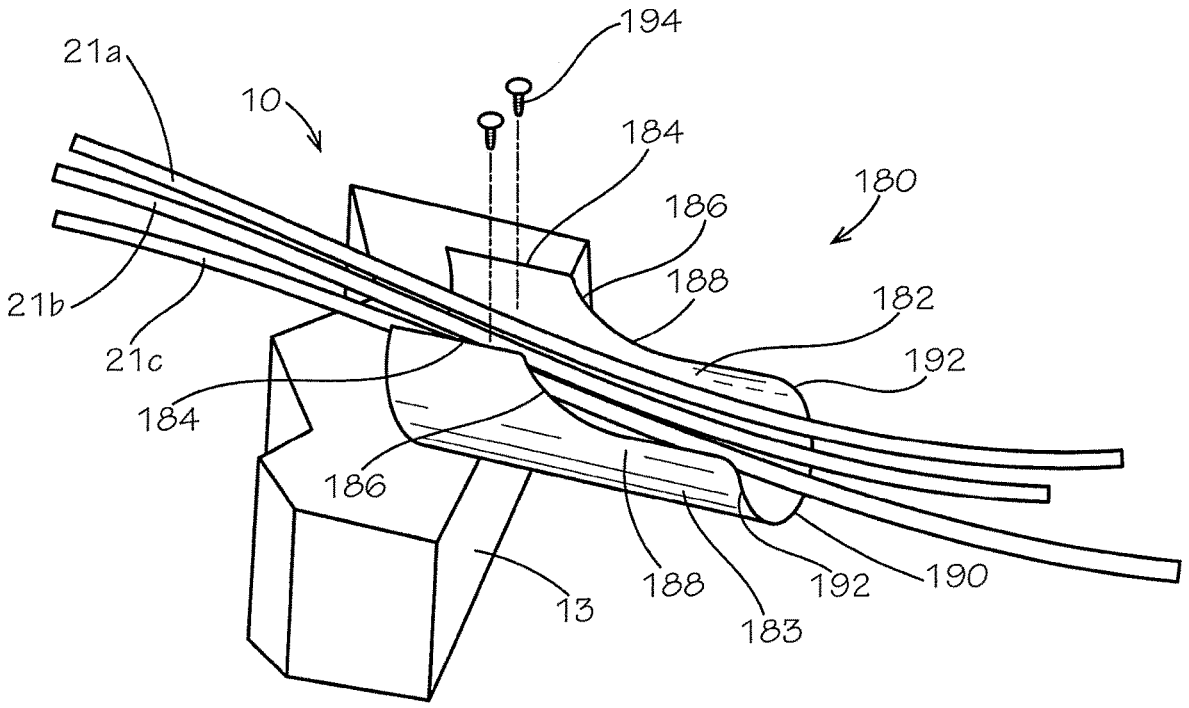
FIG. 10 illustrates in perspective detailed view a balloon tying device of the balloon tying station shown in FIG. 1 for knotting and ornamentalizing an inflated balloon in accordance with the present invention.

FIG. 10 illustrates in perspective detailed view a balloon tying device 180 of the balloon tying station 10 shown in FIG. 1, which balloon tying device 180 attaches as a cantilever extending from an edge of the base plate 13 for tying a knot in a balloon in accordance with the present invention. The balloon tying device 180 comprises a portion of an elongated circular pipe cut longitudinally along opposing lines to define an open trough 182 with outside surface 183. The trough 182 has two opposing upper edges 184 that extend into respective arcuate curved surfaces 186 and extending therefrom as a tapering but generally horizontal plateau 188 to a distal end 190. The distal end 190 in the illustrated embodiment is finished with an arcuate or curved passing edge 192 to facilitates the removal of a tied knotted balloon from the balloon tying device by rolling-off of the tied knotted balloon from the cantilever. The tapering of the plateau 188 reduces the surface across which the neck portion stretches to facilitate removal of the neck portion of the inflated balloon from the cantilever during the knotting process. Fasteners 194 secure a leading end portion of the balloon tying device to the base plate 13.

Alternately, the upper edges 184 terminate in a respective vertically extending retaining edge that leads to a generally horizontal plateau before extending as the tapering curved surface 186, such as provided in the balloon tying device 30 shown in FIG. 1. The retaining edge maintains the position of a stretched portion of the neck portion of the balloon during the knot tying steps. The plateau keeps the balloon tying operation sufficiently above the cantilever trough for insertion of a finger into the trough during balloon-tying operations.

The plurality of ribbons 21*a*, 21*b*, and 21*c* extend from respective spools longitudinally through the trough 182, for being secured to the knotted neck portion of the balloon during knotting. The neck portion of the balloon stretches transverse over the trough 182 proximate the base 13, and underneath and around the cantilever trough, so that the end of the neck portion carried upwardly may then slip under the transverse stretched portion. The distal end of the neck portion is pulled longitudinally to tie a knot in the neck portion of the balloon while capturing the ribbons 21 therein. Continued longitudinal pulling of the neck portion secures the knot while pulling the neck portion off the distal end 190 of the cantilever balloon tying device 180.

Figure 11:
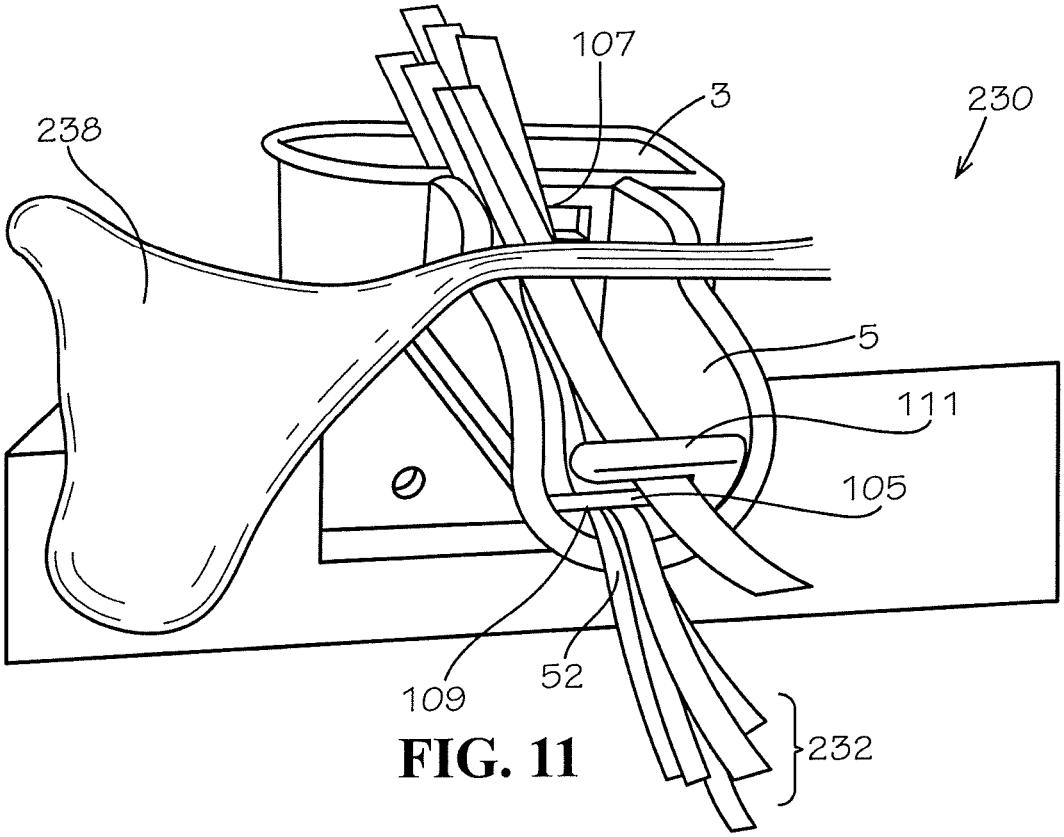
FIG. 11 illustrates a balloon tying device of a type attached to a balloon tying station for oranmentialization of an inflated balloon.
Figure 12:
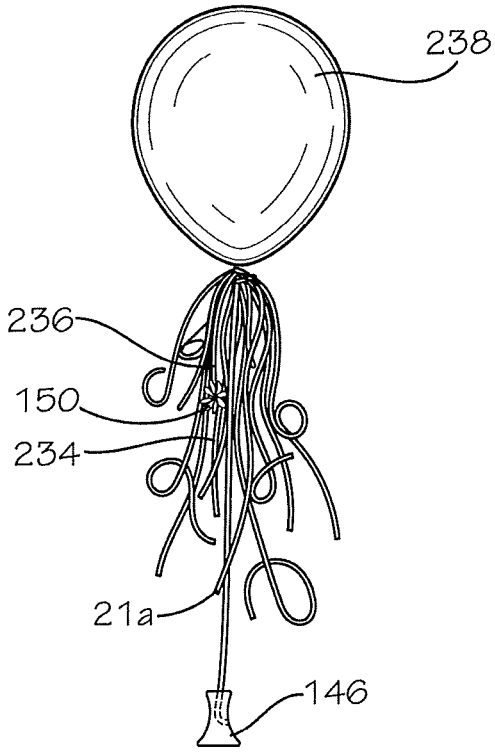
FIG. 12 illustrates an inflated balloon ornamentalized in accordance with the present invention.

Further, FIG. 11 illustrates a balloon tying device 230 of a type described in my U.S. patent application Ser. No. 15/694,655 attached to a balloon tying station for oranmentialization of an inflated balloon, as show in FIG. 12. In this illustrative embodiment, ribbons 232 are pulled longitudinally from respective spools 20 and extended through the ribbon retainer slot 107, along the trough of the cantilever 5, and under the bridge 111 at the distal end to a first length. Being disposed under the bridge requires the ribbons later to be cut from the spool for removing from the balloon tying device 230. Continuing the ornamentalization, another group of ribbons 234 are pulled longitudinally from respective spools and extended through the gap 109 under the arm 105 longitudinally a second length. The another ribbons 234 are cut proximate the respective spools and folded over the arm 105 medial opposing ends of the second length. Continuing the ornamentialization, an additional another group of ribbons 236 are extended from respective spools along the cantilever and through the gap 109 a third length. Similarly, a twine may be co-expended therewith. The first length, the second length and the third length may be the same or different. For example, the first length may be 25 inches, the second length 40 inches and the third length 30 inches. The twine may be longer for a holding member or for securing to a weight. An inflated balloon 238 is knotted as discussed above by stretching the neck portion around the cantilever and pulling the distal end underneath and longitudinally to knot the neck portion and engage the lengths of ribbons 232, 234, 236 and the twine in the knot. The initial ribbons of the first length are then cut proximate the respective spools. The ribbons may be curled for ornamentaization and otherwise decorated with the decorative device 148 as discussed above, such as the bow 150, the conical party hat 152, the signage 153, the sticker, the toy, or the other ornamental character or feature with a descriptive text or article related to a theme or to the design expressed in the balloon bouquet.

The forgoing describes the present invention in various illustrative embodiments of the invention. Those skilled in the art may recognize other equivalents to the specific embodiments described herein which equivalents are intended to be encompassed by the claims attached hereto.

What is claimed is:

1. A method for ornamentializing an inflated balloon, comprising the steps of:

(a) providing a supply of a first ribbon and a supply of a second ribbon for onamentializing an inflated balloon having a neck portion for knotting a knot with respective portions of the first ribbon and the second ribbon;

(b) pulling the first ribbon a first length relative to a neck portion of the inflated balloon to position a portion of the first ribbon adjacent the neck portion for being engaged to the knot when knotting the neck portion;

(c) pulling the second ribbon a second length relative to the neck portion of the inflated balloon to position a portion of the second ribbon adjacent the neck portion for being engaged to the knot when knotting the neck portion;

(d) knotting the neck portion of the inflated balloon with the respective portions of the first ribbon and the second ribbon in the knot to secure the first ribbon and the second ribbon in the knot and thereby defining (i) a first strand of the first ribbon extending from the knot to a distal end of the first ribbon and (ii) a first strand of the second ribbon extending from the knot to a distal end of the second ribbon;

(e) cutting the first ribbon between the knot and the supply of the first ribbon to define a second strand of the first ribbon of a third length; and (f) cutting the second ribbon between the knot and the supply of the second ribbon to define a second strand of the second ribbon of a fourth length;

whereby the first strand of the first ribbon defines an elongated ribbon for holding the inflated balloon from floating away and the respective second strand of the first ribbon and the first and second strands of the second ribbon ornamentialize the inflated balloon.

2. The method as recited in claim 1, further comprising the steps of:

attaching an elongated member to the knotted neck of the inflated balloon;

attaching a third ribbon and a fourth ribbon to the elongated member; and attaching each one of a pair of ornamental devices to a respective one of the third ribbon and the fourth ribbon.

3. The method as recited in claim 2, wherein the elongated member comprises an elongated wire having a plurality of fiber bristles extending therefrom, and the attaching step comprises bending the elongated wire around the neck portion of the inflated balloon.

4. The method as recited in claim 2, wherein one of the pair of the ornamental devices comprises a bow.

5. The method as recited in claim 2, wherein one of the pair of the ornamental devices comprises a conical party hat.

6. The method as recited in claim 2, wherein one of the pair of the ornamental devices comprises a signage device.

7. The method as recited in claim 1, further comprising the step of attaching an ornamental device to the inflated balloon with a ribbon.

8. The method as recited in claim 1, wherein the supply of the first ribbon and the supply of the second ribbon are provided on respective spools attached to a balloon tying station comprising:

a rack having a plurality of spaced-apart axles each for receiving the respective spool of the first ribbon and the second ribbon for selectively dispensing the respective ribbon longitudinally in a dispensing direction and a support plate projecting from the rack in the dispensing direction; and a balloon tying device fixedly seated on the support plate as an elongated tying member extending as a cantilever therefrom; and wherein the knotting step comprising the first and the second ribbon being dispensed longitudinally across the rack and the cantilever in the dispensing direction for underlying the neck portion of the inflated balloon, which neck portion extends laterally stretchingly around an exterior of the cantilever and upwardly to loop (a) over the stretched portion and then (b) under the stretched portion, and being pulled longitudinally in the dispensing direction off of the cantilever to catch the respective portions of the first ribbon and the second ribbon and form the knot in the neck portion and securing the respective portions of the first ribbon and the second ribbon in the knot.

9. The method as recited in claim 1, further comprising the step of attaching one or more ornamental stickers to a respective one or more of the first strand of the first ribbon, the second strand of the first ribbon, the first strand of the second ribbon, and the second strand of the second ribbon.

10. A method for ornamentializing an inflated balloon, comprising the steps of:

(a) providing a knotted inflated balloon;

(b) bending an elongated member having a plurality of fiber bristles extending therefrom at a portion intermediate opposing distal ends to the knotted neck of the inflated balloon;

(c) attaching a pair of ribbons to the elongated member, each proximate a respective one of the distal ends of the elongated member; and (d) attaching each one of a pair of ornamental devices to a respective one of the pair of ribbons.

11. The method as recited in claim 10, wherein one of the pair of the ornamental devices comprises a bow.

12. The method as recited in claim 10, wherein one of the pair of the ornamental devices comprises a conical party hat.

13. The method as recited in claim 10, wherein one of the pair of the ornamental devices comprises a signage device.

14. The method as recited in claim 10, further comprising the step of attaching an ornamental device to the inflated balloon with a ribbon.

15. The method as recited in claim 10, further comprising the step of attaching one or more ornamental stickers to a respective one or more of the pair of ribbons.

* * * * *